US005816045A

United States Patent [19]

Blöcker et al.

[11] Patent Number: 5,816,045

[45] Date of Patent: Oct. 6, 1998

[54] FAN-TYPE EXHAUST GAS MANIFOLD FOR MULTI-CYLINDER INTERNAL-COMBUSTION ENGINES AND METHOD OF MAKING SAME

[75] Inventors: Henning Blöcker, Stelle; Thomas Hülsberg, Rosengarten; Ralf Pünjer, Hamburg, all of Germany

[73] Assignee: Mercedes-Benz AG, Stuttgart, Germany

[21] Appl. No.: 615,596

[22] Filed: Mar. 13, 1996

[30] Foreign Application Priority Data

Mar. 23, 1995 [DE] Germany ..... 195 10 602.4

[51] Int. Cl.[6] ..... F01N 7/08

[52] U.S. Cl. ..... 60/323; 137/602; 29/890.08

[58] Field of Search ..... 60/313, 323; 137/602; 29/890.08

[56] References Cited

U.S. PATENT DOCUMENTS

| | | | |
|---|---|---|---|
| 4,022,019 | 5/1977 | Garcea | 60/323 |
| 4,819,428 | 4/1989 | Ciccarone | 60/323 |
| 5,010,731 | 4/1991 | Onishi | 60/323 |
| 5,471,835 | 12/1995 | Friedman | 60/323 |

FOREIGN PATENT DOCUMENTS

| | | |
|---|---|---|
| 8312091 U | 9/1983 | Germany . |
| 58-90317 | 6/1983 | Japan . |
| 4-129834 | 11/1992 | Japan . |

*Primary Examiner*—Willis R. Wolfe
*Attorney, Agent, or Firm*—Evenson, McKeown, Edwards & Lenahan, P.L.L.C.

[57] ABSTRACT

A fan-type manifold for multi-cylinder internal-combustion engines has several first individual pipe sections which are connected in pairs to respective ones of second pipe sections. The first individual pipe sections are undeformed on the end and are cut off at a specific angle. The second pipe sections are produced by an internal high pressure deforming process. The first pipe sections are plugged into the second pipe sections at respective Y-type combining points to form Y-shaped connections and are sealingly welded to each other via surrounding fillet welds. One of the second pipe sections has an additional Y-type combining point for the lateral connection of the other second pipe sections, which are sealingly welded thereto via surrounding fillet welds.

20 Claims, 3 Drawing Sheets

FAN-TYPE EXHAUST GAS MANIFOLD FOR MULTI-CYLINDER INTERNAL-COMBUSTION ENGINES AND METHOD OF MAKING SAME

BACKGROUND AND SUMMARY OF THE INVENTION

This invention is based on a fan-type exhaust gas collector for multi-cylinder internal-combustion engines structured in a tree-shape, as known for example, from German Patent Document DE 83 12 091.2 U1.

In the case of the fan-type manifold known from the above-mentioned document, the individual pipe sections of the first collecting plane are deformed on their downstream ends in pairs in a mirror-inverted D-shaped manner with an open circumferential side and are welded to these sides in a Y-shaped obtuse manner, the end area of the double pipes of the first collecting plane which are prefabricated in this manner being constructed in a double-D-shape with an approximately circular total cross-section. These double pipes of the first collecting plane are then joined with the pipe sections of the second and that of the third collecting plane, a butt welding being provided on the connection points. With respect to manufacturing techniques and flow aspects, this type of construction of the fan-type manifold is not optimal because the parts must be welded together in two different steps, because the prerequisite for the butt weldings is a high manufacturing precision of the component parts and because, nevertheless the transitions of the clear openings from the first to the second collecting plane cannot be optimally constructed. In addition, in the case of diameter tolerances and/or a transverse offset of the pipe sections, steps are formed at the joining points which counteract the flow.

It is an object of the invention to improve the fan-type manifold of the type on which this invention is based in such a manner that it can be manufactured at more reasonable cost but nevertheless at the same time ensures a fluidically favorable guiding of the exhaust gases.

Based on the fan-type manifold of the above-mentioned type, this object is achieved according to the invention by providing an arrangement for a fan-type exhaust gas manifold comprising an integrally formed first section containing a first plurality of individual exhaust pipe sections, an integrally formed second section disposed downstream of said first section and containing a second plurality of individual pipe sections, said second plurality being one-half of the first plurality, and an integrally formed third section disposed downstream of said second section and containing a pipe section, wherein said pipe sections of said first and second section are connected by plug in connections and surrounding weld seams, said second section including Y-type sections joining two respective pipe sections of said first sections.

With the exception of the connection flanges, the total of six required component parts of the fan-type manifold according to the invention, in the case of a fan-type manifold for a fourfold cylinder bank, are, on the one hand, formed by four different pipe benders with linearly bounded, possibly diagonally cut ends and by two different IHU-parts which can all be manufactured at reasonable cost and with a high dimensional precision. The parts can be plugged together in a correct position in one device and can be welded together in this one chucking. Because of the plugging-together of the parts, length tolerances can be easily absorbed within relatively wide margins. In this manner of joining, diameter tolerances in the area of the joining points can also easily be absorbed, mainly, however, without any flow-impeding projections.

In comparison to a fan-type manifold of the above-mentioned type on which the invention is based, the following advantages of the fan-type manifold are achieved:

(i) Because of the plug-in technique, within a relatively large area, length tolerances of the component parts can be compensated during the assembling of the fan-type manifold without any impairment of the welding quality or of the interior surface of the exhaust gas pipe.

(ii) The required weld seams are all of the same type and arrangement, specifically surrounding fillet welds; they may all be welded in a single workpiece chucking.

(iii) The pipe ends to be plugged in do not have to be shaped in a high-expenditure manner (for example, no D-shape) but must only be cut off at a specific angle.

(iv) Changes of the pipe cross-section with respect to the cross-sectional shape and/or the cross-sectional surface which become necessary along the length can easily be shaped without any additional costs on the pipe sections of the second collecting plane manufactured by the IHU-process.

(v) No flow-impeding steps are formed during the assembling and welding-together of the fan-type manifold.

(vi) For the above-mentioned reasons regarding manufacture, good flow conditions can be ensured in the exhaust gas collector.

(vii) Because of the avoidance of flow impeding structures, when dimensioning the clear flow opening of the exhaust gas pipes, no "reserve" must be taken into account; on the contrary, without any loss of function caused by the manufacturing, the dimensioning may take place at the lower dimensioning limit, which results in smaller pipe size and reduced costs and weight of the fan-type manifold.

In comparison to the half-shell method of construction of a fan-type manifold, the advantages of the fan-type manifold according to the invention are as follows:

(a) A reasonable-cost manufacturing is permitted because the separate branching pieces and their insertions required for a half-shell method of construction are omitted.

(b) In comparison to a construction with separate branching pieces in the half-shell method of construction, the fan-type manifold requires considerably fewer component parts, specifically, in the case of a fan-type manifold with four pipe sections of the first collecting plane on the end side, only six component parts in comparison to otherwise fourteen component parts.

(c) Significantly fewer weld seams for the welding-together of the lower part number are required; specifically, in the case of the selected example, only a total of five circumferential seams in comparison to eight circumferential seams plus six longitudinal seams on the branching pieces fitted together in a half-shell manner.

Other objects, advantages and novel features of the present invention will become apparent from the following detailed description of the invention when considered in conjunction with the accompanying drawings.

DETAILED DESCRIPTION OF THE DRAWINGS

Figures 1, 1A:
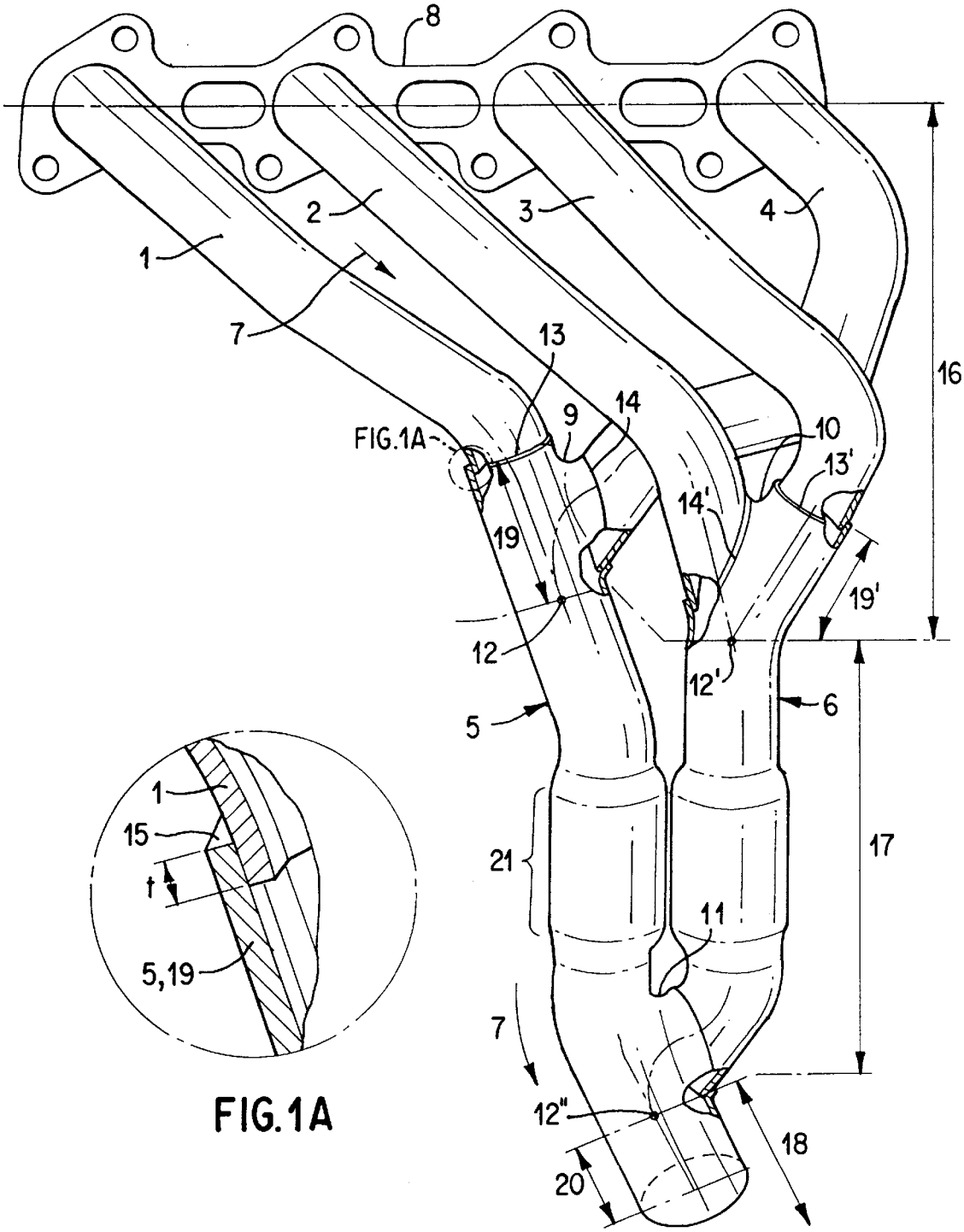
FIG. 1 is a perspective view of a fan-type manifold in a direction from the outside transversely onto the cylinder-head-side flange, constructed according to a preferred embodiment of the invention.
FIG. 1A is a sectional enlarged view of detail A of FIG. 1.
Figure 2:
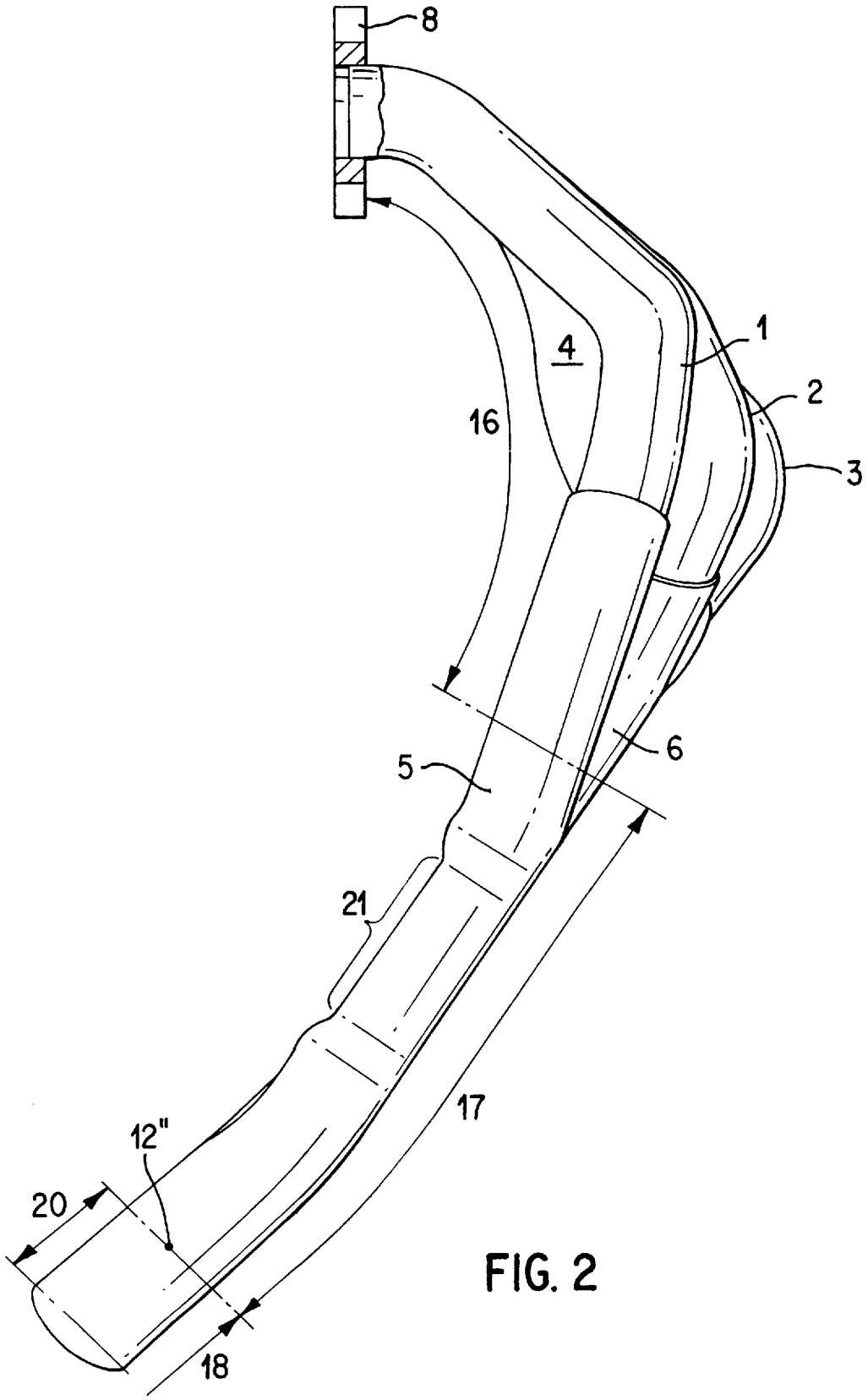
FIG. 2 is a view of the fan-type manifold according to FIG. 1 in parallel to the cylinder-head-side flange.
Figure 3:
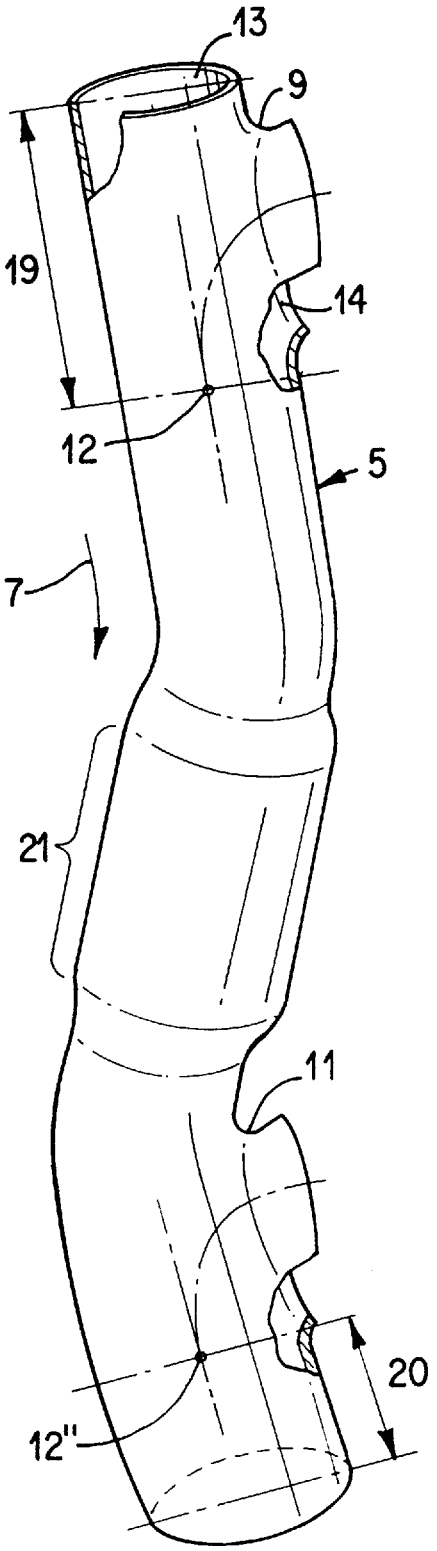
FIG. 3 and 4 are each a representation of a detail of the two pipe sections of the second collecting plane of the fan-type manifold according to FIGS. 1 and 2.
Figure 4:
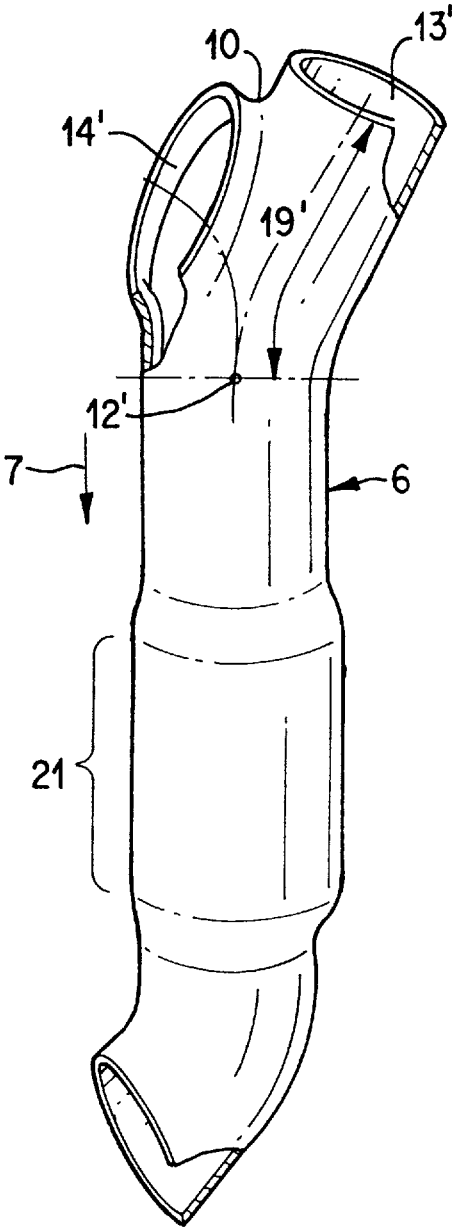

FIGS. 1 and 2 illustrate a fan-type exhaust gas collector—a so-called "fan-type manifold", which is structured in a tree shape, for collecting and guiding together exhaust gases of a—in the example shown—four-cylinder internal-combustion engine. Accordingly, the fan-type manifold has four individual pipe sections 1, 2, 3, and 4 in a first collecting group or plane 16 which originate from a flange 8 and of which one respectively is assigned to a working space of the internal-combustion engine. The individual pipe sections produced from bent pipes are at least constructed with respect to one another within the fan type manifold in a rough approximation to have approximately the same length and extend in an unbranched manner, up to the combining points to be mentioned later. The pipe sections are guided together in pairs to form flow paths of a second collecting group or plane 17 which also have approximately the same length with respect to one another, and these flow paths, in turn, are guided together to form a uniform pipe section of a third collecting plane 18 by way of Y-shaped pipe constructions. The individual, bent pipe sections of the fan-type manifold which are fittingly shaped and cut on the end side are joined in the correct position and are welded together in a sealing manner.

In order to be able to construct the fan-type manifold at reasonable cost but to nevertheless be able to ensure a fluidically favorable guiding of the exhaust gases, the following measures or characteristics are provided on the fan-type manifold.

The four individual pipe sections 1, 2, 3 and 4 of the first collecting plane 16 are constructed into the areas of the combination to the second collecting plane 17, to retain the same diameter and the same cross-sectional shape and are cut there on the end side only at a specific angle. The pipe sections are constructed as pipe benders which can be manufactured at reasonable cost and may be obtained from a low-priced, not pretreated initial product, specifically circular pipes. The pipe ends to be plugged in do not have to be shaped in a high-expenditure manner (for example, no D-shape) but must only be cut off at a specific angle.

The pipe sections 5, 6 of the second collecting plane 17 are constructed separately without any seams and are manufactured from circular pipes as the initial product by the internal high pressure deforming method (IHU process), by means of which relatively complicated shapes can be manufactured at reasonable cost. The pipe sections 5, 6 of the second collecting plane extend—against the flow direction 7—with an integrated projection 19, 19' constructionally to in front of the combining point 12 and 12' of the two respective pertaining individual pipe sections 1 and 4 or 2 and 3 of the first collecting plane 16. In the area of the upstream ends, a Y-type combining point 9 or 10 is integrated into the pipe sections of the second collecting plane. As a result, in in addition to the front-side opening 13 or 13', a circumference-side opening 14 or 14' is also created so that, in each opening, one respectively of the four individual tube sections of the first collecting plane can be connected.

The individual pipe sections of the first collecting plane are each plugged into the open, larger-diameter openings 13, 13', 14, 14' of the Y-type combining points 9 and 10 and are each welded on there in a sealing manner by means of a surrounding fillet weld 15. Because of the plugging technique, within a relatively large area, length tolerances of the component parts during the assembling of the fan-type manifold can be compensated without any impairment of the welding quality or of the interior surface of the exhaust gas pipe because the pipe sections can easily be plugged more or less deeply (measurement t) into the corresponding receiving opening, as depicted in FIG. 1A. During the assembling and welding-together of the fan-type manifold, no flow-impeding steps are created. Together with the joining of the pipe sections for the flow paths of the second to the third collecting plane explained below, this joining takes place in a chucking and welding device. The required weld seams are all of the same type and arrangement, specifically surrounding fillet welds. All five surrounding weld seams may be welded in the case of a single workpiece chucking.

One, specifically the larger pipe section 5 of the second collecting plane 17 extends with a projection 20 in the flow direction 7 constructionally to behind the combining point 12" of the two flow paths of the second collecting plane 17 and, close to its downstream end, has another Y-type combining point 11 for the lateral connecting of the smaller pipe section 6 of the second collecting plane. Behind the other Y-type combining point, the larger pipe section 5 changes with its downstream projection 20 into the third collecting plane 18 where a continuing exhaust gas pipe may be connected in a detachable manner or may be welded on. The end of the smaller pipe section 6 of the second collecting plane is plugged into the larger-diameter opening 22 of the additional Y-type combining point 11 and there is also welded on in a sealing manner by means of a surrounding fillet weld 15.

In the area of the guiding-together of two flow paths, the pipe cross-section must be enlarged along the length in order to be able to ensure a constant flow. These required changes with respect to the cross-sectional shape and/or cross-sectional surface may be shaped easily onto the pipe sections of the second collecting plane manufactured by the IHU process without any additional cost. The enlargement of the clear flow opening from the individual cross-section of the first collecting plane 16 to the larger flow cross-section of the second collecting plane 17 takes place as a result of a corresponding shaping of the pipe wall in the area of the projections 19 or 19' of the upstream Y-type combining points 9 and 10 by the shaping tool of the IHU process. In a completely corresponding manner, the clear flow opening from the individual cross-section of the second collecting plane 17 to the larger flow cross-section of the third collecting plane 18 must also be enlarged which here also takes place in the area of the downstream, additional, Y-type combining point 11 because of a corresponding shaping of the pipe wall. This shaping is caused by the shaping tool used in the internal high pressure deforming process without any additional costs.

Finally, space-caused or installation-caused flat areas 21 on the pipe sections 5, 6 of the second collecting plane 17 can easily be shaped on by a shaping of the pipe wall in this area during the internal high pressure deforming process. The clear flow opening in the range of these flat areas may easily be dimensioned to be oval and, in the clear cross-sectional surface to be larger than in the area of the undisturbed circular cross-section. Because of this possibility, during the dimensioning of the clear flow opening of the exhaust gas pipes, no "reserve" must be taken into account; on the contrary, without any loss of function caused by the manufacturing, the dimensioning may take place on the lower dimensioning limit which benefits a smaller pipe size, the costs and the weight of the fan-type manifold.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Fan-type exhaust gas manifold which is structured in a tree shape, for collecting and guiding together exhaust gases of a multi-cylinder internal-combustion engine, the fan-type manifold having several, mutually approximately equally long, unbranched, bent individual pipe sections in a first collecting plane which are each assigned to a working space of the internal-combustion engine and which are combined in pairs to also mutually approximately equally long pipe sections of a second collecting plane, and these in turn, are combined to form a uniform pipe section of a third collecting plane by way of Y-shaped pipe constructions, the fan-type manifold being welded together from individual, bent pipe sections which are fittingly shaped and cut on the respective end sides, wherein, the individual pipe sections of the first collecting plane are constructed to be constant with respect to their diameter and cross-sectional shape into the area of the combining to the second collecting plane and are approximately flat there on the end side and are cut at a specific angle, wherein, the pipe sections of the second collecting plane are manufactured separately and seamlessly by means of an internal high pressure deforming process (IHU Process) and extend against the flow direction constructionally to in front of the combining point of the two pertaining individual pipe sections and of the first collecting plane and there have an integrated, Y-shaped combining point for the front-side and circumference-side connecting of one individual pipe section respectively of the first collecting plane, wherein, the individual pipe sections of the first collecting plane are each plugged into open, larger-diameter openings of the Y-type combining point of the pipe section of the second collecting plane and are, in each case, welded on to the pipe section of the second collecting plane by means of a surrounding fillet weld, wherein, one of the pipe sections of the second collecting plane extends in the flow direction constructionally to behind the combining point of the pipe sections of the second collecting plane and, close to its downstream end, has another Y-type combining point for the lateral connecting of another pipe section of the second collecting plane, the end of the pipe section with the additional Y-type combining point with its downstream end changing into the third collecting plane, and wherein the other pipe section of the second collecting plane is plugged into the larger-diameter opening of the additional Y-type combining point of the one pipe section of the second collecting plane and is sealingly welded on there by means of a surrounding fillet weld.

2. Fan-type manifold according to claim 1, wherein the enlargement of the clear flow opening from the individual cross-section of the first collecting plane to the larger flow cross-section of the second collecting plane takes place as a result of a corresponding shaping of the pipe wall in the area of the upstream Y-type combining point of the pipe sections of the second collecting plane by means of the internal high pressure deforming process.

3. Fan-type manifold according to claim 1, wherein the enlargement of the clear flow opening from the individual cross-section of the second collecting plane to the larger flow cross-section of the third collecting plane takes place as the result of a corresponding shaping of the pipe wall in the area of the downstream additional Y-type combining point of the pipe section of the third collecting plane by means of the internal high pressure deforming process.

4. Fan-type manifold according to claim 1, wherein the clear flow opening of the pipe sections of the second collecting plane in the range of the space-caused flat areas of these pipe sections takes place by an oval shaping of the pipe wall in this area which is larger in the clear cross-sectional surface than in the area of the undisturbed circular cross-section by means of the internal high pressure deforming process.

5. A fan-type exhaust gas manifold comprising:

a first section containing a first plurality of exhaust pipe sections;

a second section disposed downstream of said first section and containing a second plurality of pipe sections, said second plurality being one-half of said first plurality, pairs of said first plurality of exhaust pipe sections being plugged into respective ones of said second plurality of pipe sections and being connected directly thereto via respective surrounding fillet welds; and a downstream portion of one of said second plurality of pipe sections defining a third section, other of said second plurality of pipe sections being plugged into said one pipe section proximate said downstream portion and being connected directly to said one pipe section via respective surrounding fillet welds.

6. A manifold according to claim 5, wherein of said pipe sections which are plugged into each other, a downstream of said pipe sections has a larger diameter such that an upstream of said pipe sections fits inside said downstream of said pipe sections.

7. A manifold according to claim 5, wherein each of said second plurality of pipe sections is manufactured as a single piece by an internal high pressure deforming process.

8. A manifold according to claim 5, wherein said first plurality is four, each of said first plurality of exhaust pipe sections being communicated with a respective cylinder of an internal combustion engine.

9. A manifold according to claim 5, wherein said pairs of said first plurality of exhaust pipe sections are plugged into respective openings integrally formed in said respective ones of said second plurality of pipe sections to form Y-shaped connections.

10. A manifold according to claim 9, wherein said other of said second plurality of pipe sections are plugged into respective openings integrally formed in said one pipe section defining the third section to form Y-shaped connections.

11. A manifold according to claim 5, wherein said other of said second plurality of pipe sections are plugged into respective openings integrally formed in said one pipe section defining the third section to form Y-shaped connections.

12. A manifold according to claim 11, wherein each of said second plurality of pipe sections is manufactured as a single piece by an internal high pressure deforming process.

13. A method of making a fan-type exhaust gas manifold comprising:

providing a first section containing a first plurality of exhaust pipe sections;

providing a second section disposed downstream of said first section and containing a second plurality of pipe sections, said second plurality being one-half of said first plurality, plugging pairs of said first plurality of exhaust pipe sections into respective ones of said second plurality of pipe sections;

connecting said pairs of said first plurality of exhaust pipe sections directly to said respective ones of said second plurality of pipe sections via respective surrounding fillet welds;

in a downstream portion of one of said second plurality of pipe sections defining a third section, plugging other of said second plurality of pipe sections into said one pipe section proximate said downstream portion; and connecting said other of said second plurality of pipe sections directly to said one pipe section via respective surrounding fillet welds.

14. A method according to claim 13, wherein of said pipe sections which are plugged into each other, a downstream of said pipe sections is formed with a larger diameter such that in said plugging step, an upstream of said pipe sections is fitted inside a downstream of said pipe sections.

15. A method according to claim 13, wherein each of said second plurality of pipe sections is manufactured as a single piece by an internal high pressure deforming process.

16. A method according to claim 13, wherein said first plurality is four, each of said first plurality of exhaust pipe sections being communicated with a respective cylinder of an internal combustion engine.

17. A method according to claim 13, wherein said pairs of said first plurality of exhaust pipe sections are plugged into respective openings integrally formed in said respective ones of said second plurality of pipe sections to form Y-shaped connections.

18. A method according to claim 17, wherein said other of said second plurality of pipe sections are plugged into respective openings integrally formed in said one pipe section defining the third section to form Y-shaped connections.

19. A method according to claim 13, wherein said other of said second plurality of pipe sections are plugged into respective openings integrally formed in said one pipe section defining the third section to form Y-shaped connections.

20. A method according to claim 19, wherein each of said second plurality of pipe sections is manufactured as a single piece by an internal high pressure deforming process.

* * * * *